US009452109B2

(12) United States Patent
Sheikh et al.

(10) Patent No.: US 9,452,109 B2
(45) Date of Patent: Sep. 27, 2016

(54) FOOD AND LIQUID DELIVERY SYSTEM FOR PACIFIER—KIDS FOOD SERVING SOLUTION IN HOME AND ON THE GO BY

(71) Applicants: Asif M Sheikh, Columbus, OH (US); Ambreen S. Qureshi, Columbus, OH (US)

(72) Inventors: Asif M Sheikh, Columbus, OH (US); Ambreen S. Qureshi, Columbus, OH (US)

( * ) Notice: Subject to any disclaimer, the term of this patent is extended or adjusted under 35 U.S.C. 154(b) by 0 days.

(21) Appl. No.: 14/022,687

(22) Filed: Sep. 10, 2013

(65) Prior Publication Data

US 2015/0069009 A1 Mar. 12, 2015

(51) Int. Cl.
*B65D 51/22* (2006.01)
*A61J 9/00* (2006.01)

(52) U.S. Cl.
CPC ..... *A61J 9/005* (2013.01); *A61J 9/001* (2013.01); *A61J 1/202* (2015.05); *A61J 1/2024* (2015.05)

(58) Field of Classification Search
CPC ..... A61J 9/00; A61J 9/008; A61J 9/005; A61J 9/001; A61J 1/2024; A61J 1/202
USPC ..... 215/11.1, 365, 11.4, 257, 276; 220/258.4
See application file for complete search history.

(56) References Cited

U.S. PATENT DOCUMENTS

| | | | | |
|---|---|---|---|---|
| 3,519,157 | A * | 7/1970 | Meierhoefer | 215/11.6 |
| 4,706,827 | A * | 11/1987 | Cabernoch | 215/11.3 |
| 4,993,569 | A * | 2/1991 | Osip | 215/226 |
| 5,662,684 | A * | 9/1997 | Caso | 606/234 |
| 5,676,277 | A * | 10/1997 | Ophardt | 222/83 |
| 6,045,254 | A * | 4/2000 | Inbar | 366/130 |
| 6,110,193 | A * | 8/2000 | Chen | 606/234 |
| 2004/0226905 | A1* | 11/2004 | Diniaco | 215/11.1 |
| 2008/0314775 | A1* | 12/2008 | Owoc | 206/222 |
| 2011/0046671 | A1* | 2/2011 | Okoturo | 606/236 |
| 2012/0022446 | A1* | 1/2012 | Desai et al. | 604/77 |
| 2014/0163463 | A1* | 6/2014 | Agbo | 604/78 |

* cited by examiner

*Primary Examiner* — J. Gregory Pickett
*Assistant Examiner* — Niki M Eloshway

(57) ABSTRACT

A pacifier food/liquid/medicine/vitamin delivery system for toddlers and infants. The system delivers contents on the go thus eliminating the need for carrying utensils and other content containers. The pacifier in front will deliver food/liquid/medicine/vitamins in mouth and a pouch attached in the back will carry the contents. When the pre-packaged content pouch/container is attached at the end of the pacifier by twisting or snapping, the penetrating edges break the seal thus allow the flow of contents in the pacifier and into the mouth. The pacifier portion comprises of elongated pieces in the bottom to apply pressure to puncture protective seal from the content pouch/container to allow contents to move in the pacifier portion. It also has a seal and a hole to relieve air to prevent colic.

3 Claims, 13 Drawing Sheets

FOOD AND LIQUID DELIVERY SYSTEM FOR PACIFIER—KIDS FOOD SERVING SOLUTION IN HOME AND ON THE GO BY

BACKGROUND

This disclosure relates to the food and liquid delivery system for pacifier. More particularly it concerns with a system of food delivery comprising of pacifier like front attached with a food or liquid content pouch/container in the end.

Traditionally pacifiers comprising a bladder extrusion connected with a stopper and a holding circle at the end used to pacify infants and toddlers.

Food and liquid delivery currently is done using baby bottles, pre-packed food containers and home-made meals.

Further, availability of many baby food products come in a container that need either a utensil to serve or in a pouch that could cause food spill.

Current food delivery systems require monitoring by the caregiver. Sometime overfeeding can occur due to not able to manage how much is being served.

Specifically for toddlers someone has to be running around with them to hold the bottle or the food to be served.

Ergonomics principles are not used in the development of food containers.

There exists a need for alternative method to deliver food and liquid on the go or at home. This invention will allow caregivers to snap or twist a pre-packaged food container or a pouch behind a pacifier. The process of snap or twist will puncture the seal and allow food delivery. Food and liquid will slip down in the mouth with each suckle to satisfy hunger. A safe, hygienic, mess-free, controlled and a timely delivery of food and liquid delivery system for infants and toddlers.

SUMMARY

For the foregoing reasons, what is needed is a device that will allow food and liquid delivery system to serve contents to infants and toddlers without additional utensils, bottles and messy food leftovers.

In accordance with the invention, a pacifier front is provided that goes in the mouth of an infant or a toddler. By suckling the pacifier end, food or liquid contents are moved into mouth to be consumed. In a version, the pacifier front comprises a nipple and a seated area for the mouth to provide grip for the lips which is interconnected with the back of the pacifier where a snap on clip or a twist exists. When in use, the snap or a twist parts of the back of the pacifier will be connected with a small disposable bag that contain food or liquid. By suckling the pacifier piece in the mouth, food will he transferred from the disposable pouch into the suckling nipple and then in the mouth.

In a version of the invention, the pacifier and the food pouch comprises of a one undetached unit where after the consumption of contents, it can be thrown away-available only for one use.

The pacifier portion can be variably shaped and sized providing that it sufficiently fits in the mouth as well as changes shape to mimic thereat mother breast like to provide love and nurturing for an infant. Preferably, the content container in the back is a pouch but can be in the shape of a cylinder, half cylinder, square, circle or other shape with an outer curved surface. The food and liquid containers can be of a variable shape and have a variable elevation relative to the surface of the base of the pacifier. Optionally the pacifier seat could be inwardly or outwardly curved, convex, concave, or in a mounded configuration. Preferably, the pacifier seat is in concave to for the shape of lips to provide better grip.

In another version of the invention, the pacifier and the food container are interchangeable with other pacifiers and food containers. Thus, if a caregiver desires to or feel to have a different shape that provides alternative characteristics, they can remove the portion from the base and replace it with another portion that provides characteristics that are more well suited for their needs. Each caregiver needs may vary depending on their infant's degree of comfort and ease of serving contents.

In yet another version of the invention, an oral suspension and or a flu shot can be administered provided and utilized in conjunction with the pacifier. The content container could be of any size or shape but the connecting portion that attaches to the pacifier functions the same way. In this version of the invention a prepackaged contents are snapped or twisted at the end of the pacifier to administer delivery.

Optionally, the pacifier and a pouch one unit combination can be used as a complete measured meal solution.

Still other benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
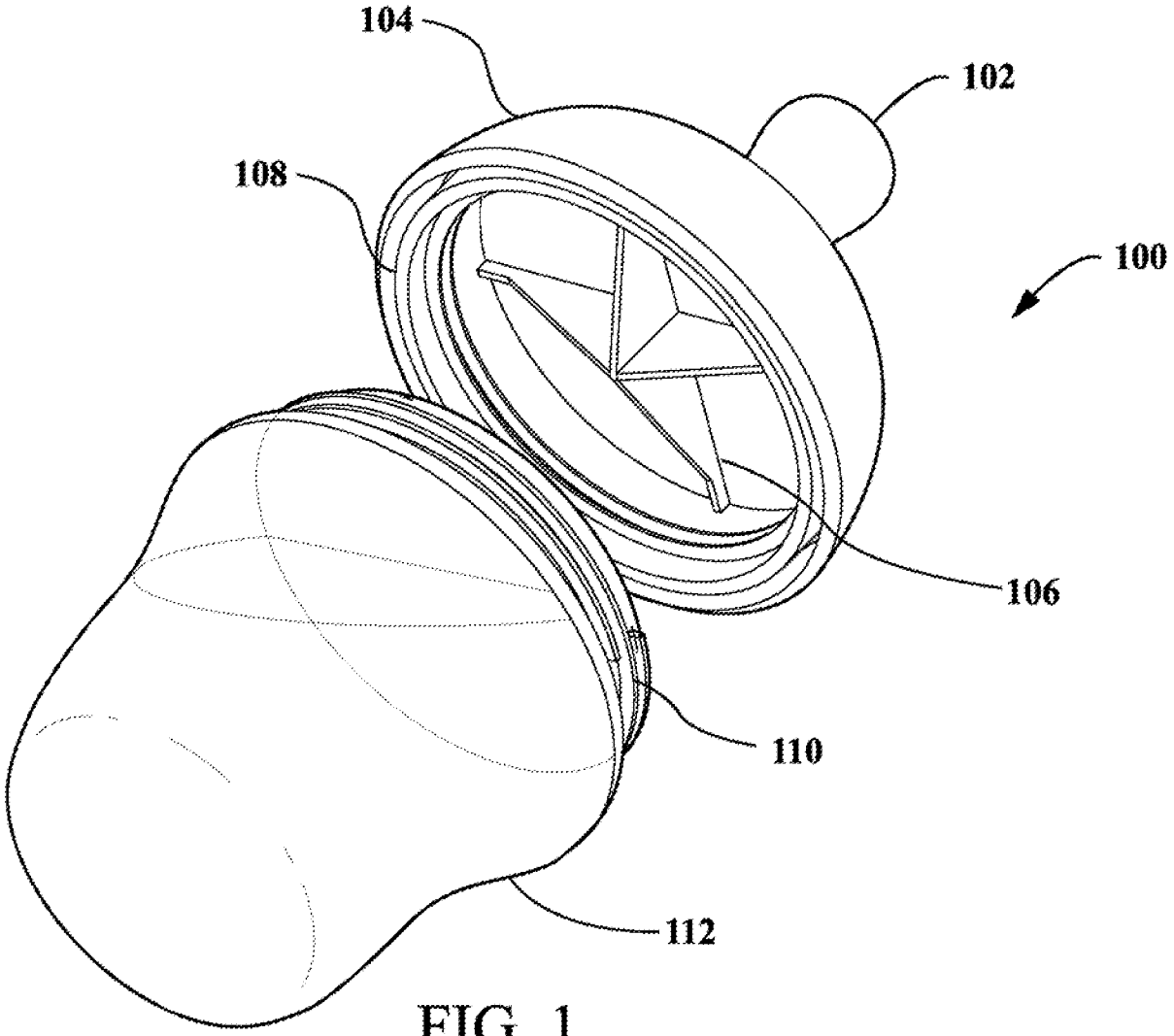
FIG. 1 is a perspective view of a version of the present invention.

Referring now to the drawings wherein the showings are only far purposes of illustrating a preferred version of the invention and not for purposes of limiting the same.

The following detailed description is of the best currently contemplated modes of carrying out exemplary versions of the invention. The description is not to be taken in the limiting sense, but is made merely for the purpose of illustrating the general principles of the invention, since the scope of the invention is best defined by the appended claims.

Various inventive features are described below that can each be used independently of one another or in combination with other features.

With reference now to the drawings, and in particular to FIG. 1-FIG. 15 thereof, a new pacifier and a connecting pouch/container embodying the principles and concepts of the present invention a id generally designated by the reference numeral 100-700 will be disclosed.

Figure 2:
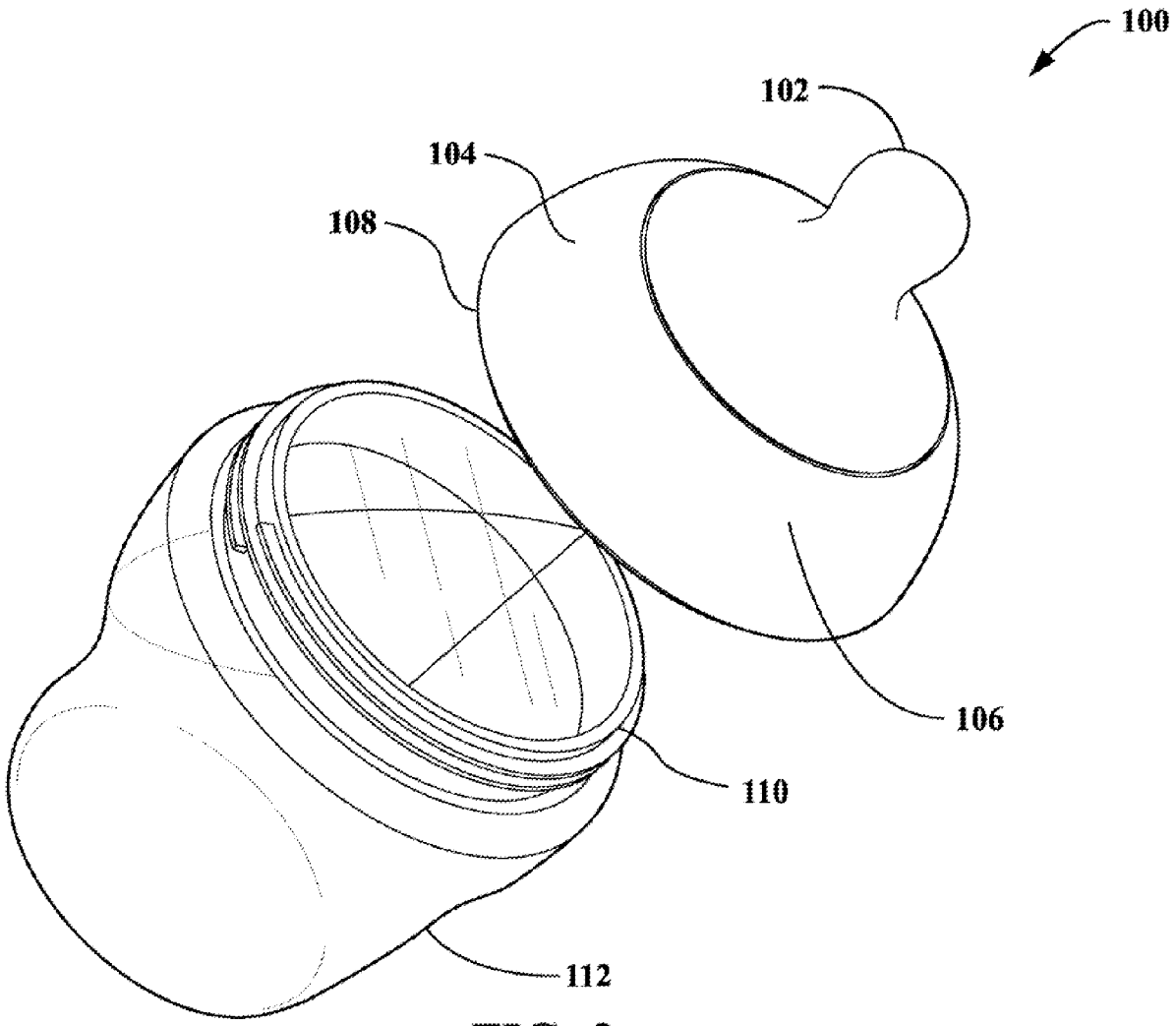
FIG. 2 is a top view of the version shown in FIG. 1.

The invention relates to a food and liquid delivery system comprises of a pacifier from with seal breaking mechanism in the back to be connected with a pouch/container. With the air vent in place, air will be allowed to prevent colic and a food or liquid will be consumed healthily by an infant and or a toddler. FIG. 1 illustrates a perspective view of a version of the present invention, and FIG. 2 is another perspective view of the version shown in FIG. 1. In the version, the food delivery system 100 comprises a pacifier nipple in front 102 for suckling in the mouth and a converse area at the end of nipple portion 104 for providing a seat or a block for the mouth for holding the apparatus.

Figure 8:
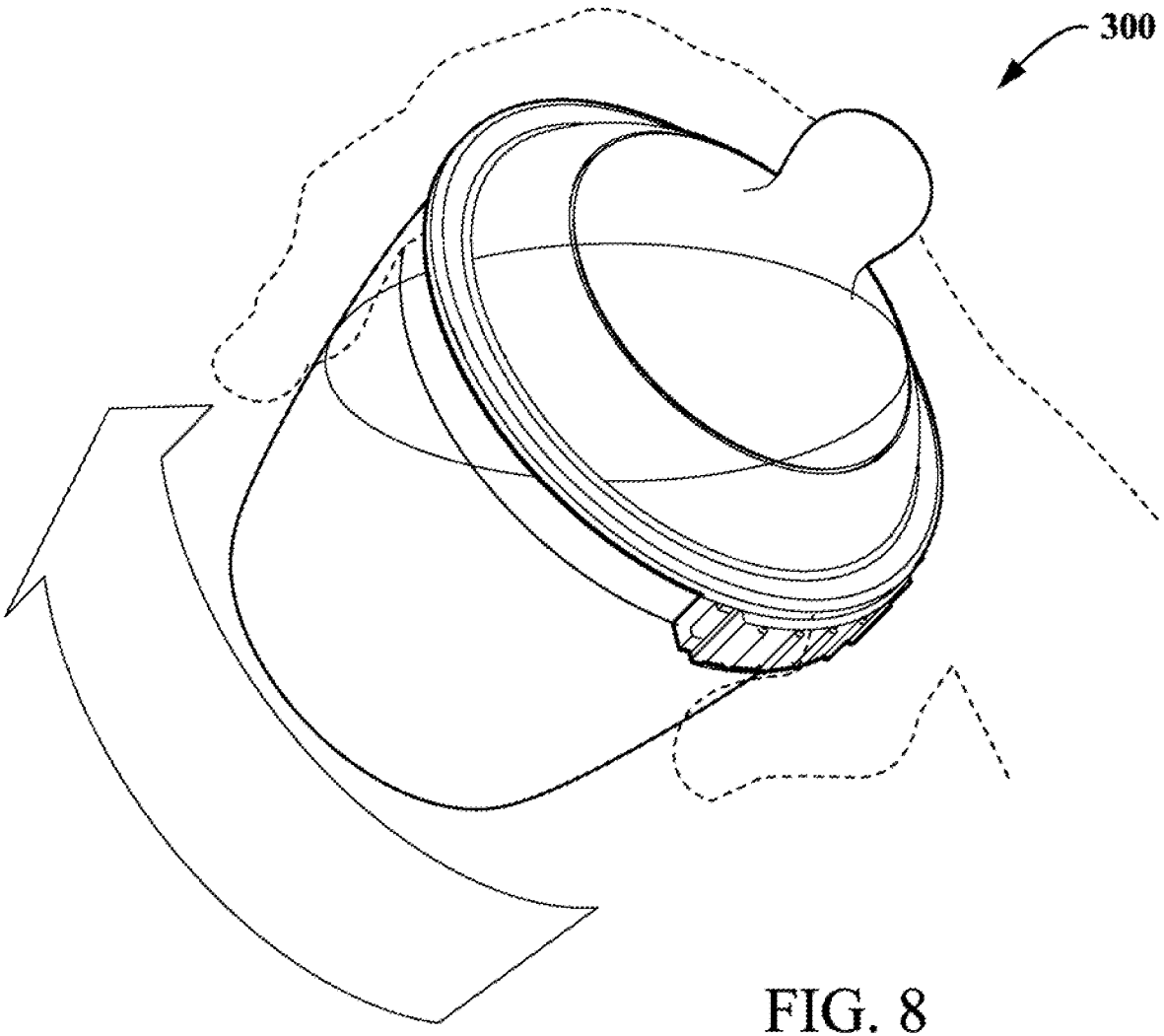
FIG. 8 is a view of the twist mechanism shown in FIGS. 6 & 7.

As depicted in FIG. 1 this version of the invention generally has two parts, one pacifier like with a nipple 102 and a seat area 104 for the mouth which will also work as a lid. At the bottom 108 of this first part a puncture mechanism 106 exist that will penetrate the seal to allow the transfer of food contents. Once the seal is broken, contents will flow in the nipple and from the nipple into mouth with each suckle. There could be various configurations and sizes that would fit the needs of a caregiver for the infant satisfaction. Further, the base of nipple 104 is depicted as concave shape and could be of convex, circular and or rounded corner rectangular, different variation of the same to provide seating for the mouth. At the end of the seating area surface 108 has the puncture mechanism which will penetrate in the seal of a pouch/container when the bottom 112 is screwed with the top 110 at the end of the pacifier 108 as the process is illustrated in FIG. 8. The seal area of the top of the food container 110 has grooves that will be used to screw in the bottom of the top portion to secure the content pouch/container. The content bag 112 can be made of plastic, aluminum foil, synthetic materials, or any other materials that are suitable for carrying consumable contents.

Figure 3:
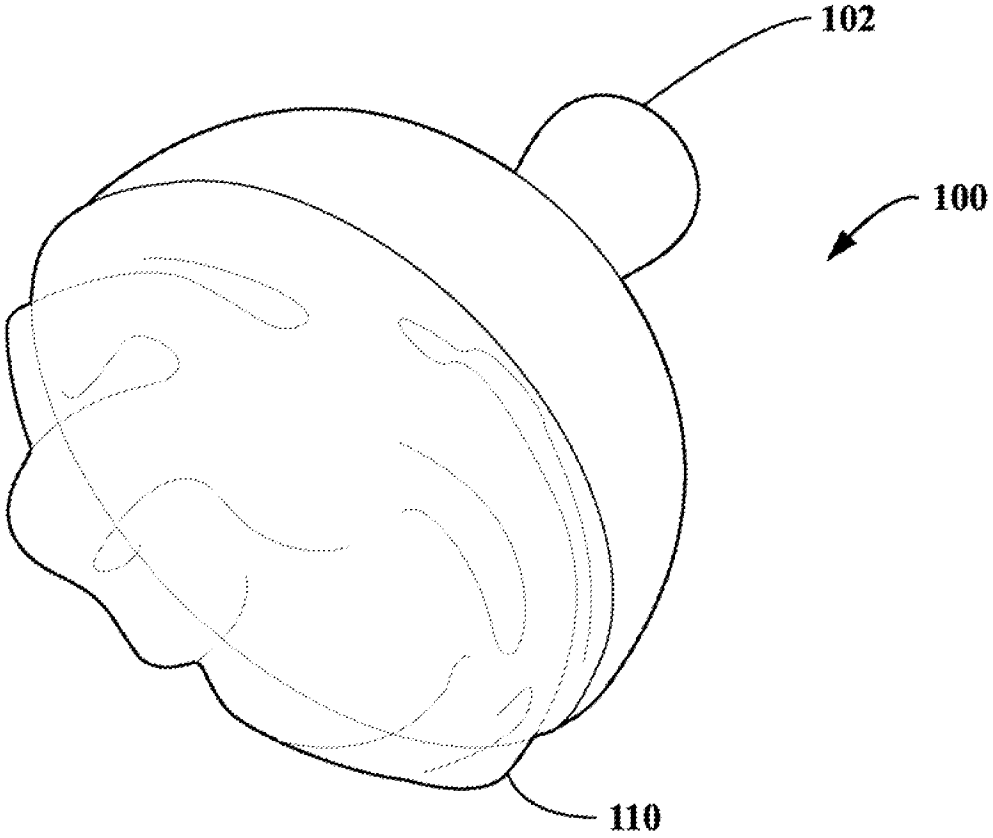
FIG. 3 is a perspective pouch view after contents are consumed in FIG. 2.
Figure 4:
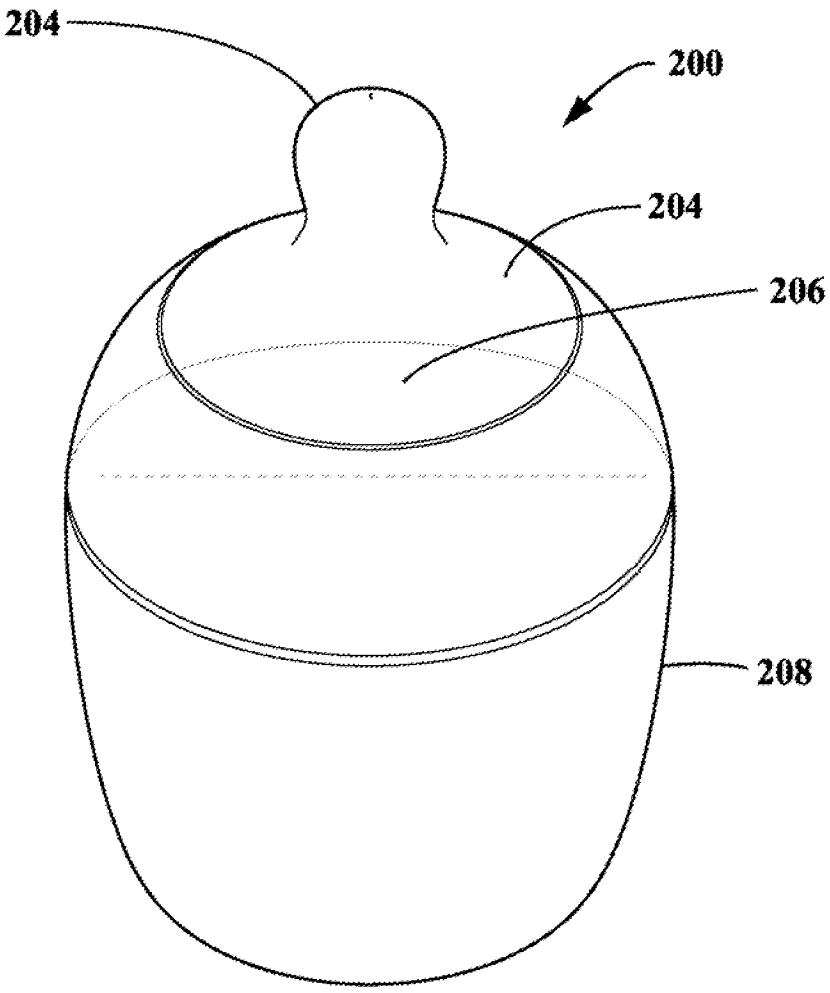
FIG. 4 is a perspective side view of a disposable version shown in FIG. 1.
Figure 5:
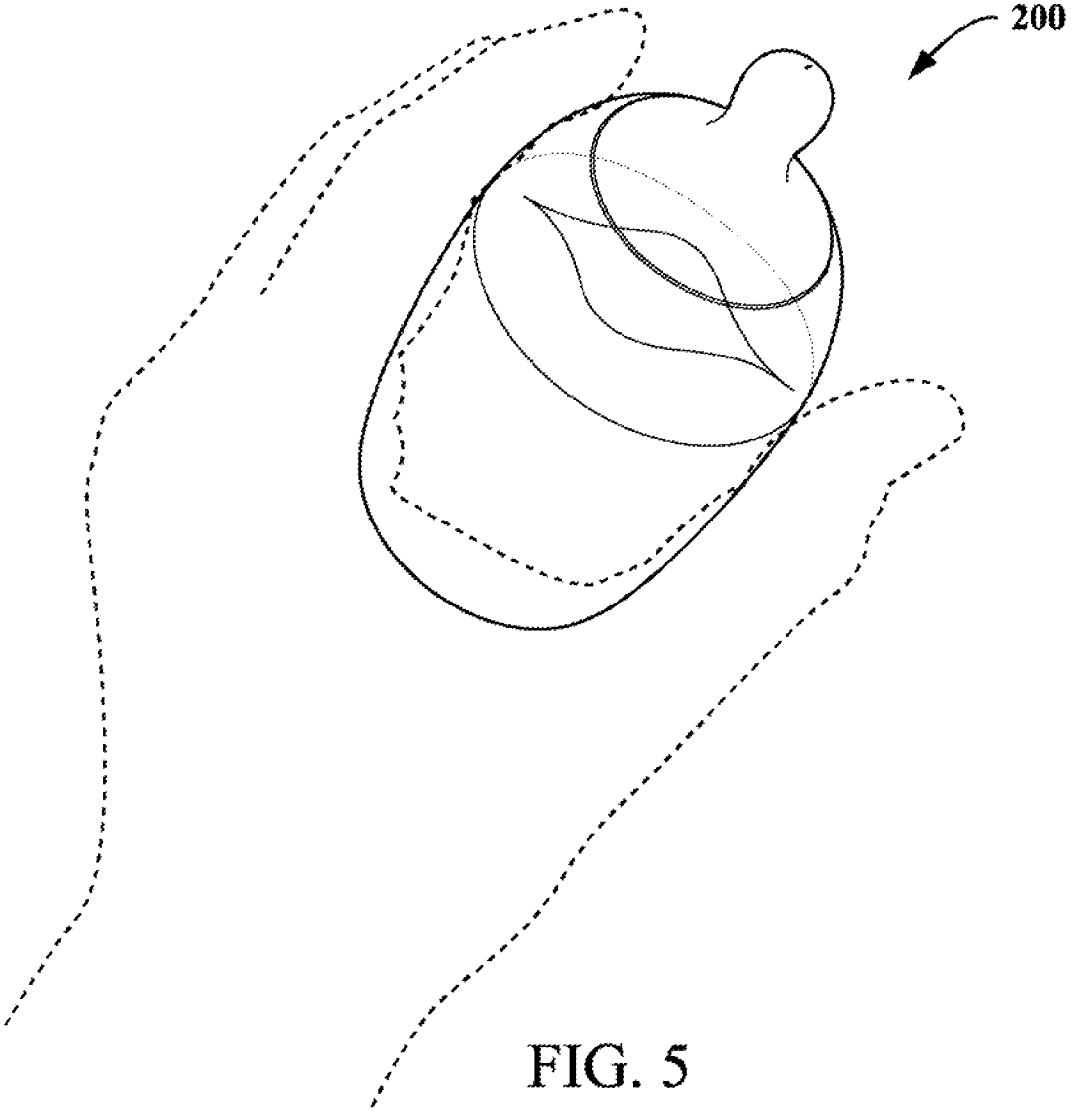
FIG. 5 is a perspective view of disposable version shown in FIG. 1.

Moreover, as depicted in FIG. 3 the content pouch will become flat after content consumption and can be untwisted and thrown away in the version 100-700 except version 200 where the top and bottom parts are interchangeable, in the disposable version 200 as depicted in FIG. 4-FIG. 5 the system can be thrown away. In the version 200 it is a disposable unit where top and bottom are connected. In FIG. 4, the nipple part 202 is attached with the seated area 204 and connected with the base 208 as one unit. In FIG. 5 there is a filament that separates the contents and has a small score line that makes the film thinner. When the bottle is squeezed, the filament breaks open allowing the contents to freely flow into the nipple for consumption.

Figure 7:
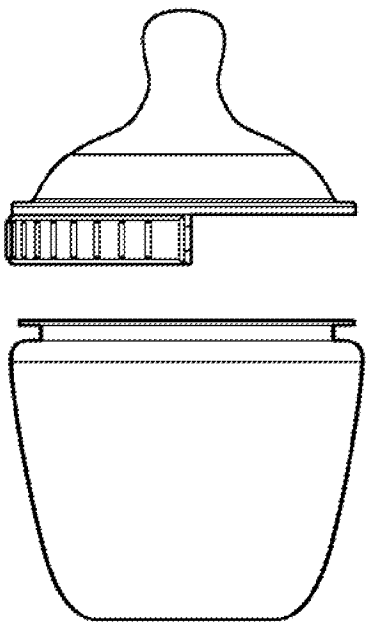
FIG. 7 is a side view of a twist version of the present invention.
Figure 6:
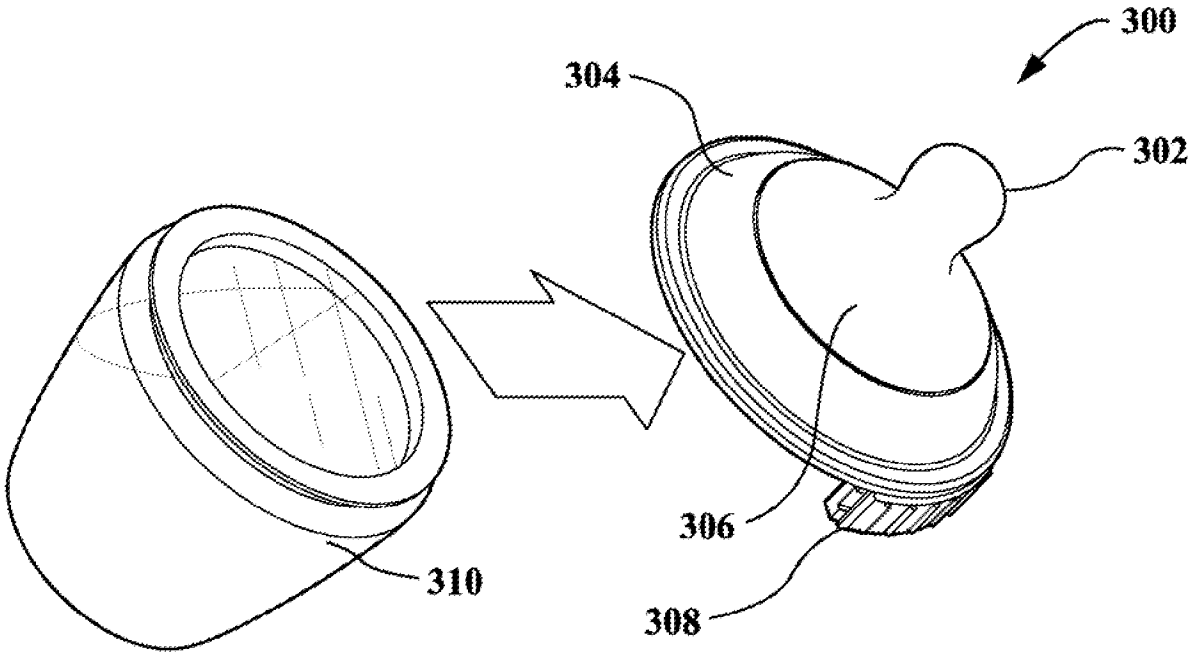
FIG. 6 is a perspective top view of another twist version shown in FIG. 1.

The FIG. 6 another version 300 of the invention shows a concept that is not screwed on, instead, the soft container has a lip 310 that holds it into the cap 308. The container is slid into the cap, and the grip area on the cap is twisted to secure the container in place. While the cap is being twisted, it also cuts through the filament on the top of the container. The nipple 302 attached with the mouth seat 304 has a twist mechanism 308 in the bottom of the top part of this version. In FIG. 7 simply shows the relation between the cap and the container. The lip on the container is clamped snugly to the lid when the grip on the lid is twisted tightly. In FIG. 8 shows how the grip is twisted to seem the cap to the container.

Figures 9, 10:
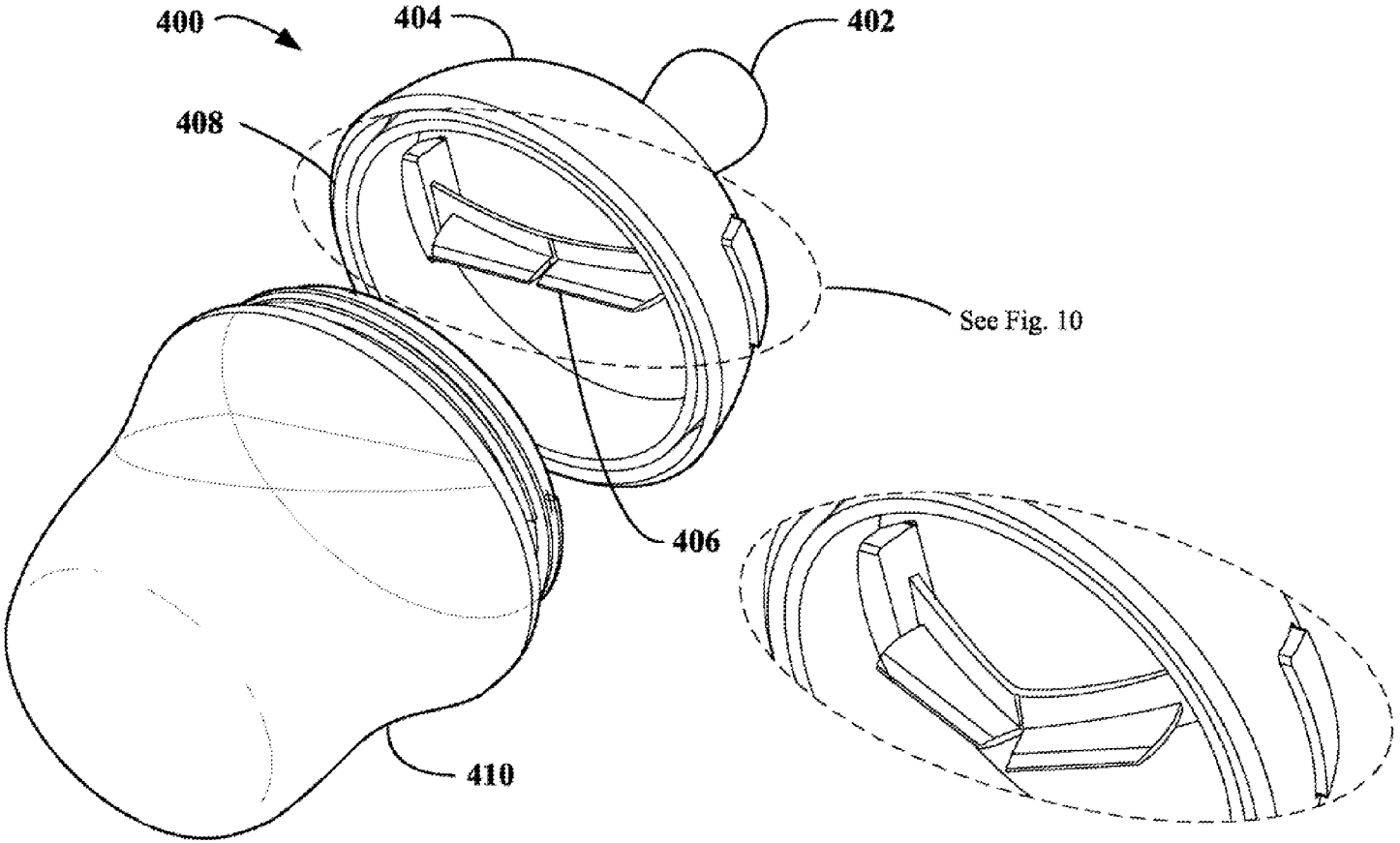
FIG. 9 is a perspective view of another version with different penetrating blade mechanism in the bottom with screwed top and with side buttons to prevent colic.
FIG. 10 is a bottom view of the version shown in FIG. 9.
Figure 11:
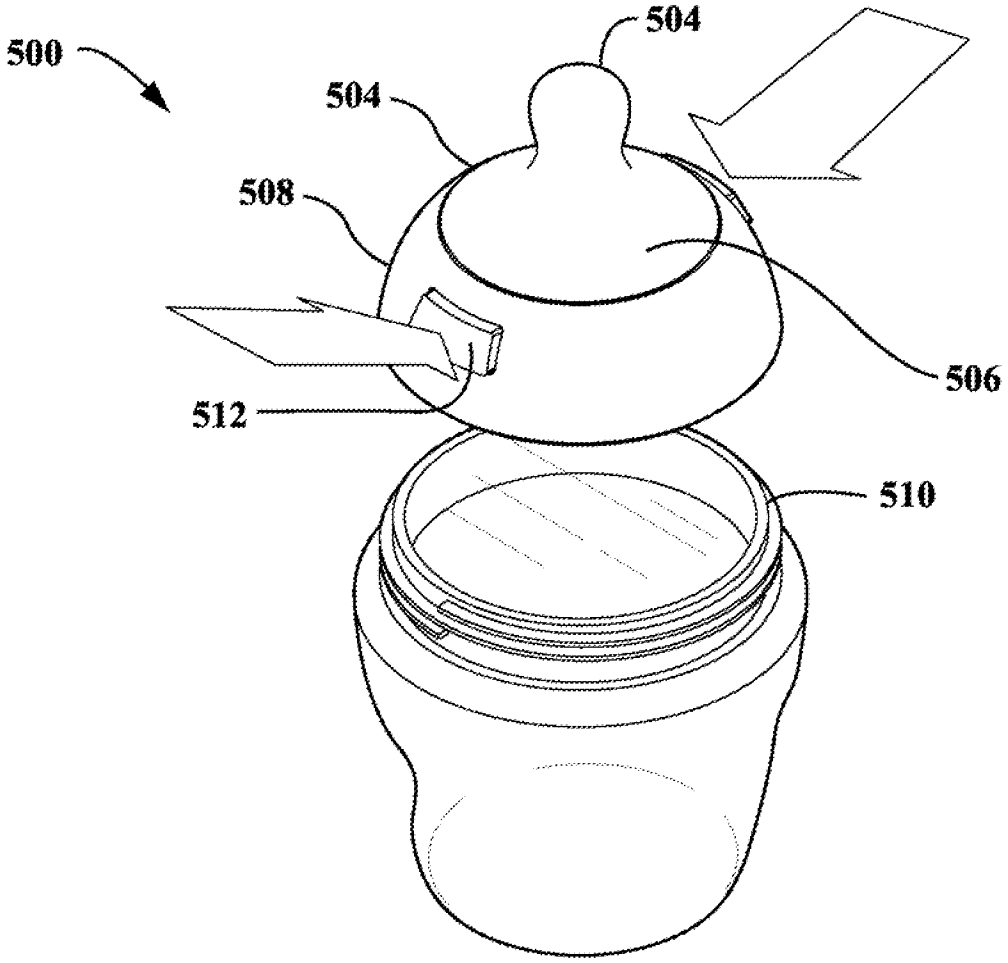
FIG. 11 is a perspective view of a version with air vent to prevent colic.

In FIG. 9-FIG. 10 another version 400 is depicted to show a different puncture mechanism using the plastic blades 406 to cut open the film of the content pouch/container. The top nipple 402 is attached with the mouth seal 404 that has two buttons each side. The two buttons on the lid are used to force the blade into the film. The two buttons are connected by a bowed piece of flexible plastic 410 that has the blades attached to it. Pushing the buttons increases the bow of the plastic, pushing the blades through the film. In FIG. 10 a detailed view of the blades in the extended position as the result of pushing the two buttons simultaneously. In FIG. 11 illustration shows the perspective use of the product in FIG. 9-FIG. 10 how the two buttons on the sides of the top are squeezed to release the contents of the container.

Figure 12:
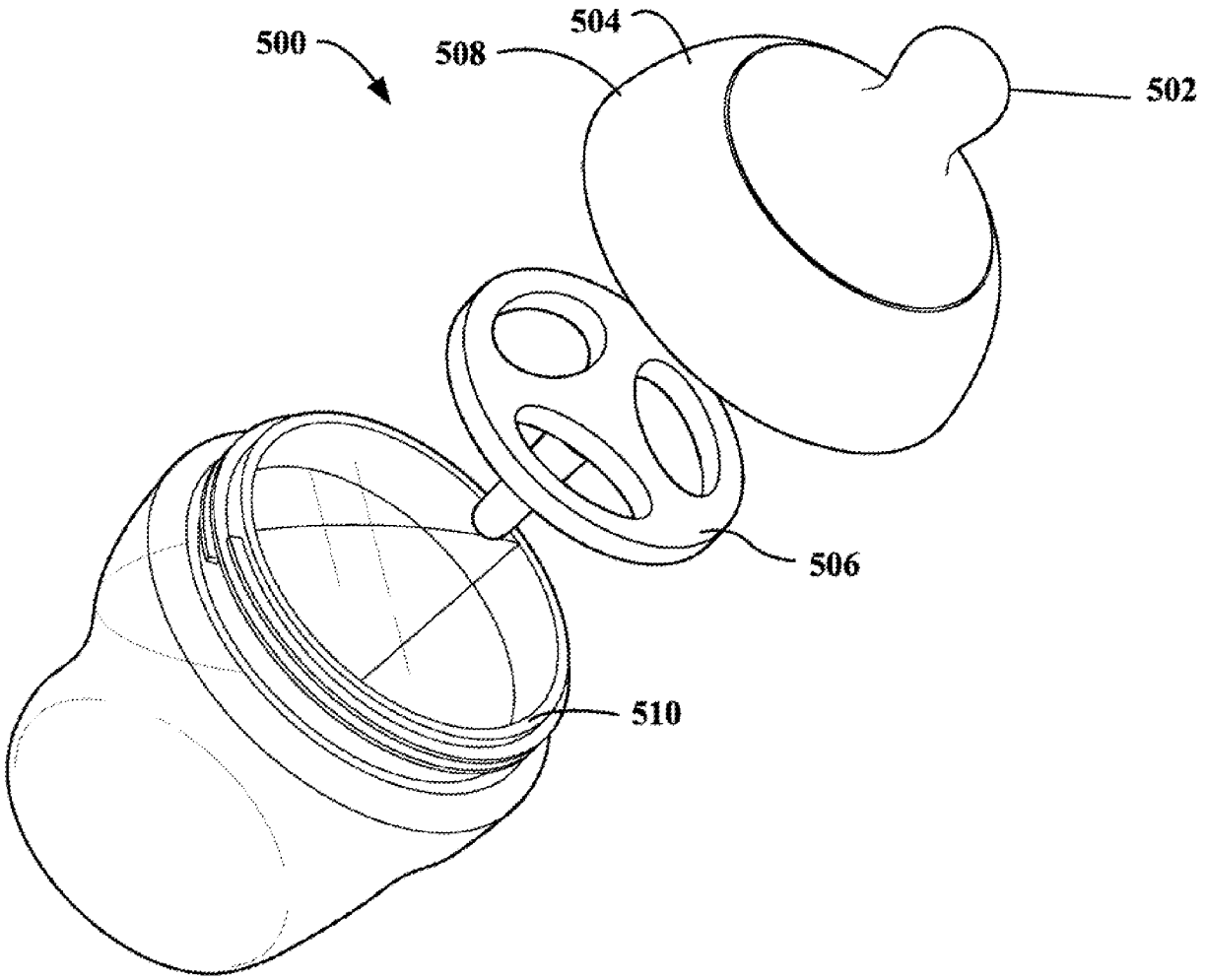
FIG. 12 is a view of an alternative version of the air vent to prevent colic.

In yet another perspective version of the invention generally depicted by the reference numeral 500 in FIG. 12 shows the incorporation of an anti-colic insert into the cap of the product for use with liquids. The anti-colic part 506 shows in the picture is only for a reference—there are many different versions and sizes that can be used to provide anti-colic feature in this system.

Figure 13:
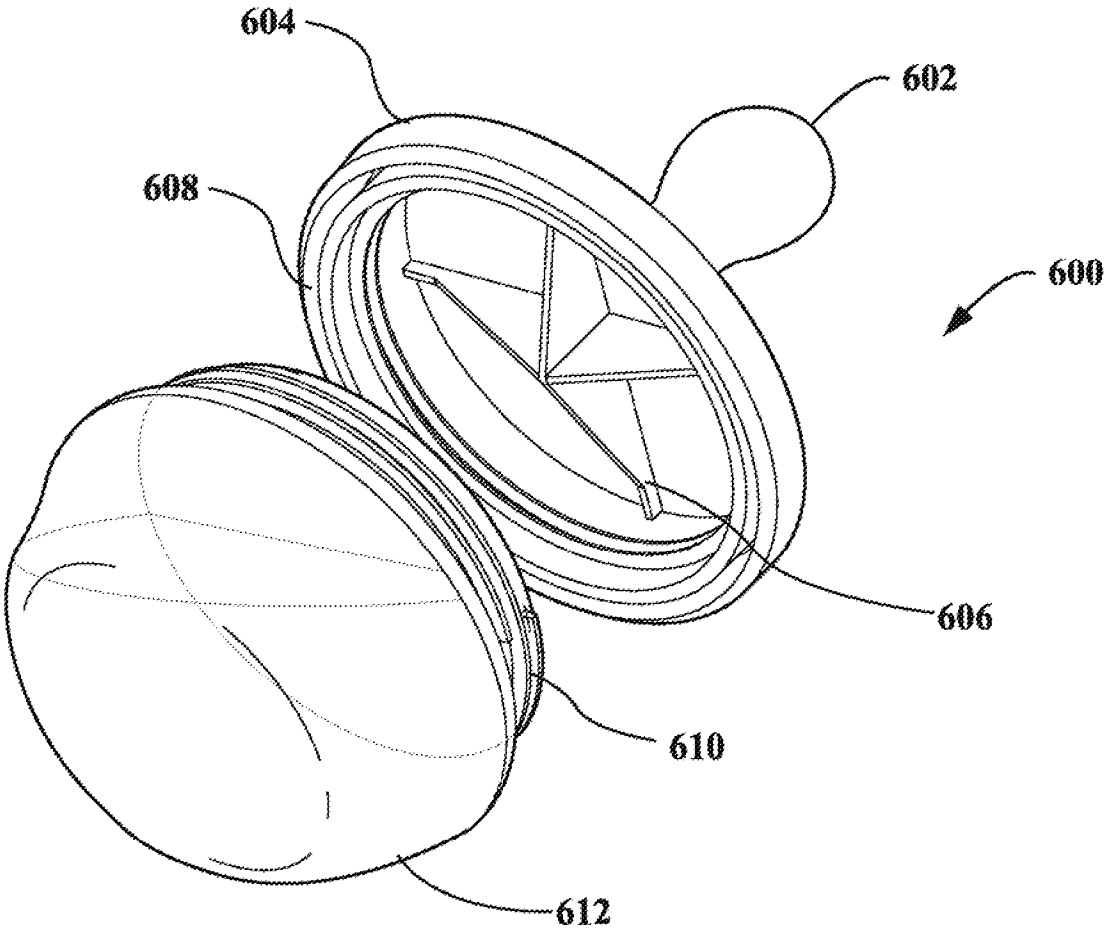
FIG. 13 is a bottom view of another version with a flat head pacifier.
Figure 14:
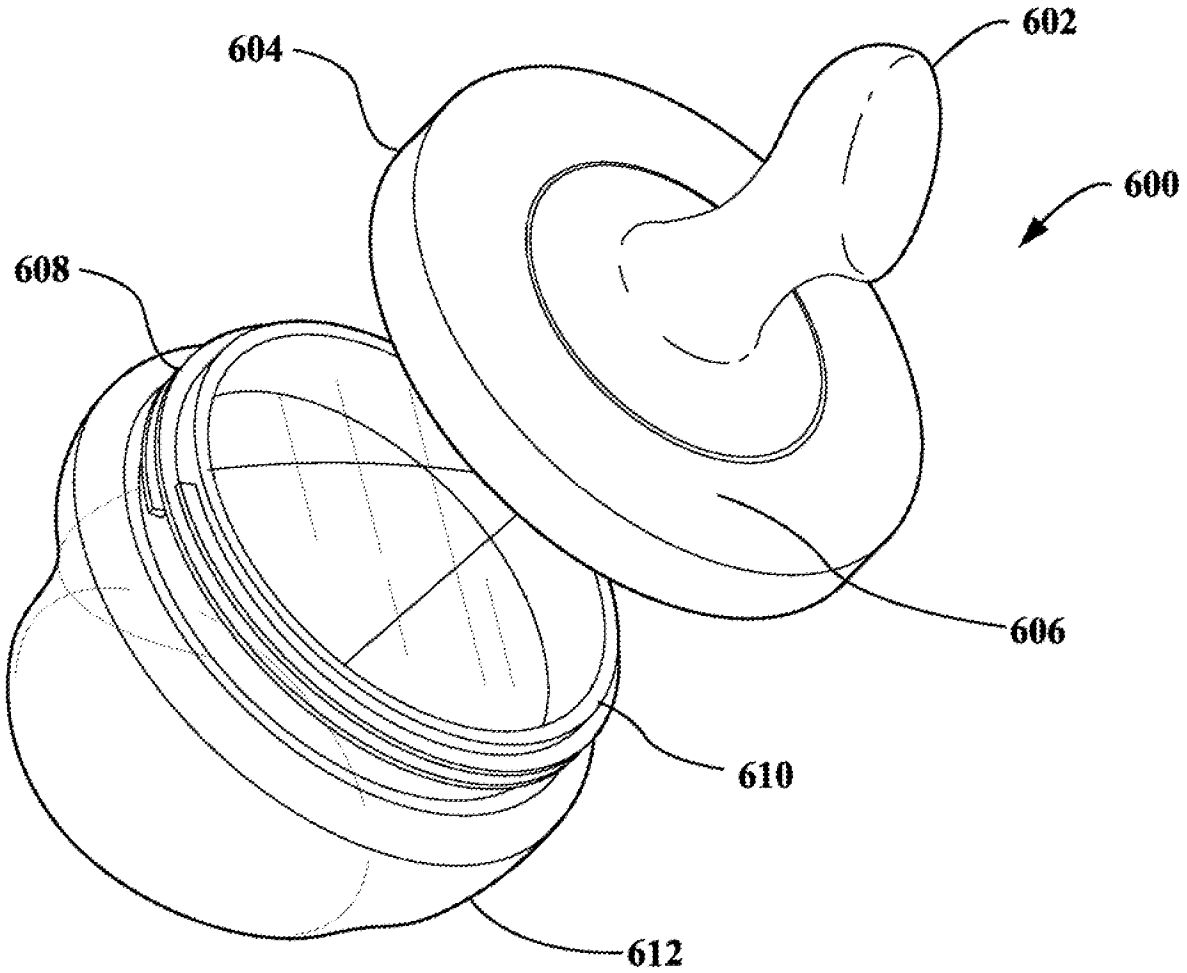
FIG. 14 is a top view of an alternative version of the present invention.

In FIG. 13-FIG. 14 another perspective view of a version 600 shows a flat seat for a mouth, different nipple shape with a very small size pouch/container.

Figure 15:
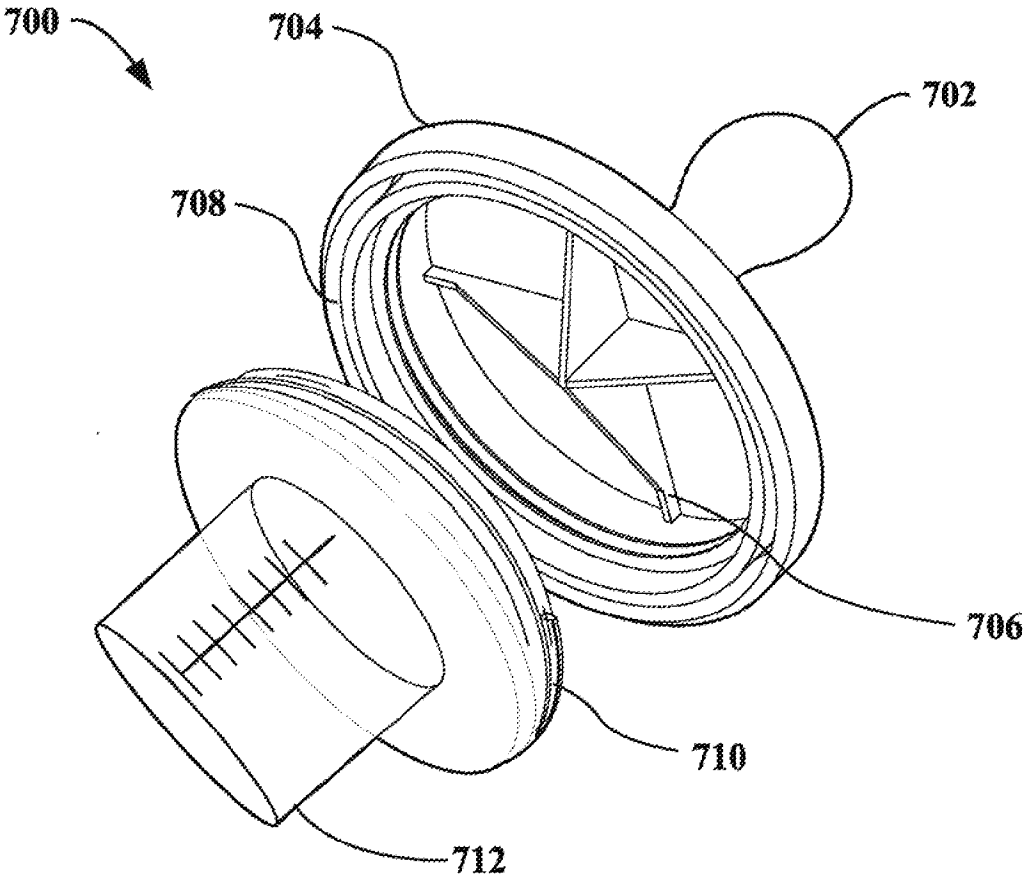
FIG. 15 is a bottom view of another version to administer medicine, shots and vaccination.

Now referring to FIG. 15 another version of the invention is generally depicted as reference numeral 700. As illustrated in FIG. 15, a bottom part is depicted as a measured content container 712 for the purpose of safe and measured administration of medicine, shots and vitamins for infants and toddlers. As depicted a prepackaged sealed container 712 screwed on 710 at 708 to become one unit. While screwing the two parts, sealed part 710 is penetrated by 706 to allow the contents into the nipple and then into mouth when suckled by infant or a toddler.

The present invention can be made in any manner and of any material chosen with sound engineering judgment. Preferably, materials will be strong, lightweight, long lasting, economic, and ergonomic.

The previously described versions of the present invention have many advantages, including providing a safe, timely and measured content delivery system that is simple to use, mess-free, convenient and a reliable solution.

The invention does not require that all the advantageous features be incorporated into every version of the invention.

Although preferred versions of the invention have been described in considerable detail, other versions of the invention are possible.

All the features disclosed in this specification (including an accompanying claims, abstract, and drawings) may be replaced by alternative features serving the same, equivalent or similar purpose unless expressly stated otherwise. Thus, unless stated otherwise, each feature disclosed is one example only of a generic series of equivalent or similar features.

What is claimed is:

1. A food delivery system for serving provisionally maintained food contents to young children, comprising:

(a) a disposable container assembly, comprising:

(i) a food container for retaining food or liquid contents having a first opening end; and (ii) a protective seal positioned adjacent the first opening end in order to provisionally maintain food contents within disposable container; and (b) a pacifier assembly, comprising:

(i) a body portion having an outer suffice, an internal cavity having a cavity wall, a top end, and a second opening end;

(ii) a nipple positioned at the top end of the body portion for delivering food and liquid contents to young children while emulating a realistic shaped and sized nipple;

(iii) a seal breaking mechanism comprising two opposing push buttons positioned on each side of the body portion of the pacifier assembly, each operably moveable through the body portion outer surface providing access to the internal cavity; a downwardly bowed flexible member connecting the two opposing buttons within the internal cavity; and two horizontally aligned penetrating edges operably connected to the flexible member, wherein while the two push buttons are simultaneously depressed toward the internal cavity, the ends of the bowed flexible member move towards each other which causes the flexible member to simultaneously bow downward, moving the penetrating edges downward at an angle, thereby breaking the protective seal of the disposable container assembly; and (iv) wherein the pacifier assembly is operably attachable to the disposable container in order to produce a sealed food delivery system during operation.

2. The food delivery system of claim 1, wherein the disposable container assembly further comprises an external helical threading projecting outward positioned annularly about the first opening end; and wherein the pacifier assembly further comprises an internal helical threading positioned annularly within the internal cavity near the second opening end configured to thread with the external helical threading of the disposable container assembly, wherein the disposable container assembly is connected to the pacifier assembly by threading the disposable container with the pacifier assembly.

3. The food delivery system of claim 1, wherein the disposable container assembly further comprises an annular groove recessed within the top of the food container positioned below the first opening end; and wherein the pacifier assembly further comprises a semi-annular connection member positioned near the second opening end configured to couple with annular groove and the first opening end of disposable container assembly, wherein the disposable container assembly is coupled to the pacifier assembly by laterally siding the pacifier assembly over the top of the disposable container assembly.

* * * * *